US009676089B2

(12) United States Patent
Sauer et al.

(10) Patent No.: US 9,676,089 B2
(45) Date of Patent: Jun. 13, 2017

(54) COMBUSTION-OPERATED SETTING TOOL

(75) Inventors: Thorsten Sauer, Goefis (AT); Norbert Heeb, Buchs (CH); Tilo Dittrich, Grabs (CH)

(73) Assignee: Hilti Aktiengesellschaft, Schaan (LI)

( * ) Notice: Subject to any disclaimer, the term of this patent is extended or adjusted under 35 U.S.C. 154(b) by 1647 days.

(21) Appl. No.: 12/321,339

(22) Filed: Jan. 15, 2009

(65) Prior Publication Data

US 2009/0188962 A1 Jul. 30, 2009

(30) Foreign Application Priority Data

Jan. 29, 2008 (DE) ..... 10 2008 000 167

(51) Int. Cl.
*B25C 1/08* (2006.01)

(52) U.S. Cl.
CPC ..... *B25C 1/08* (2013.01)

(58) Field of Classification Search
CPC ..... B25C 1/08
USPC ..... 227/10; 123/46 R
See application file for complete search history.

(56) References Cited

U.S. PATENT DOCUMENTS 4,522,162 A * 6/1985 Nikolich ..... 123/46 SC
4,712,379 A * 12/1987 Adams et al. ..... 60/632
4,721,240 A * 1/1988 Cotta ..... 227/10
4,773,581 A * 9/1988 Ohtsu et al. ..... 227/10
5,090,606 A * 2/1992 Torii et al. ..... 227/10
5,199,626 A * 4/1993 Terayama et al. ..... 227/10
5,752,643 A * 5/1998 MacVicar et al. ..... 227/10
6,260,519 B1 * 7/2001 Phillips ..... 123/46 R
6,311,887 B1 * 11/2001 Walter ..... 227/10
6,520,127 B1 * 2/2003 Thieleke et al. ..... 123/46 R
6,755,159 B1 * 6/2004 Adams et al. ..... 123/46 R
6,783,045 B2 * 8/2004 Shima et al. ..... 227/8
6,863,045 B2 * 3/2005 Ricordi ..... 123/262
7,305,940 B2 12/2007 Nishikawa
7,467,739 B2 * 12/2008 Fujisawa et al. ..... 227/10
7,594,599 B2 * 9/2009 Webb ..... 227/10
2003/0094148 A1 5/2003 Toulouse

* cited by examiner

*Primary Examiner* — Gloria R Weeks
(74) *Attorney, Agent, or Firm* — Abelman, Frayne & Schwab

(57) ABSTRACT

A combustion-operated setting tool (10) for driving-in fastening elements includes a setting piston (14) displaceable in a guide cylinder (13), a combustion chamber (15), a fuel inlet (23) opening into the combustion chamber (15) for feeding fuel therein and an ignition element (26) for igniting the fuel in the combustion chamber (15). Both, the fuel inlet (23) and the ignition element (26), are located at the first end (31) of the combustion chamber (15) adjacent to the guide cylinder (13), and a motor-driven ventilator (16) supported on a rear wall (30) of the combustion chamber (15) at the second end (32) of the combustion chamber (15) remote from the guide cylinder (13).

14 Claims, 2 Drawing Sheets

COMBUSTION-OPERATED SETTING TOOL

BACKGROUND OF THE INVENTION

1. Field of the Invention

The present invention relates to a combustion-operated setting tool for driving in fastening elements, and including a guide cylinder, a setting piston displaceable in the guide cylinder, a combustion chamber defining a combustion chamber axis and having a first end adjacent to the guide cylinder and a second end spaced from the guide cylinder; a fuel inlet opening into the combustion chamber for feeding fuel therein and located at the first end of the combustion chamber, an ignition element for igniting the fuel in the combustion chamber, and a ventilator supported on a rear wall of the combustion chamber at the second end of the combustion chamber.

2. Description of the Prior Art

The setting tools of the type described above can operate, e.g., with gaseous or liquid vaporizable fuels. During a setting process, the setting piston is driven by expanding combustion gases for driving a fastening element in a workpiece. Before start of the combustion process, fuel is injected in the combustion chamber and is mixed with air that fills the combustion chamber by a ventilator or impeller. Simultaneously, the turbulence, which is necessary for combustion, is produced. After the combustion process, the ventilator blows out the combustion products from the combustion chamber and aspirates fresh air in. For cooling the power tool, the ventilator is operated after rinsing of the combustion chamber and is turned off after a predetermined time period. The ventilator is driven by a motor, preferably, electric motor. The ignition of the air-fuel mixture that fills the combustion chamber is effected with an ignition device that includes, e.g., a spark plug.

European Publication EP 1 693 158 A1 discloses a combustion-operated setting tool of the type discussed above and including a combustion chamber and a ventilator located therein. The ventilator is driven by a motor which is supported in a recess in a combustion chamber rear wall that is formed as a cylinder head. A fuel inlet, which opens into the combustion chamber extends through the cylinder head. The fuel inlet is connected with a fuel source by a fuel conduit. An ignition element of an ignition device and which is formed as a spark plug likewise is arranged on the cylinder head. Both the fuel inlet and the spark plug, which are located in the combustion chamber, are, thus, located behind the ventilator in the flow direction of the flow produced by the ventilator.

The drawback of having the fuel inlet and the ignition element located behind the ventilator (at the rear wall) consists in that the ignition of the air-fuel mixture is only then possible when the fuel, which was injected in the combustion chamber, has been uniformly turbulently distributed to a most possible extent. The user, in order to insure a reliable ignition, should, therefore, actuate the trigger switch, which actuates ignition, only after a certain time delay after injection of the fuel in the combustion chamber (usually, the injection is initiated by the setting tool being pressed against a workpiece). This necessary delay period can be perceived by the user as troublesome. When the injection of fuel is initiated by the setting tool being pressed against a workpiece, then pressing and actuation of the trigger switch simultaneously or immediately after the press-on movement of the setting tool would lead to disturbances or even failures of the ignition.

Accordingly, an object of the present invention is to provide a combustion-operated setting tool of the type described above in which it is possible to set a fastening element disturbance-free and with a sufficient drive energy already after a minimal delay period between the injection of fuel in the combustion chamber or pressure of the setting tool against a workpiece and actuation of the setting process by the trigger switch.

SUMMARY OF THE INVENTION

This and other objects of the present invention, which will become apparent hereinafter, are achieved by providing a combustion-operated setting tool in which both the fuel inlet and the ignition element are located at the first end of the combustion chamber opposite the second end at which the ventilator is arranged. As a result, both the fuel inlet and the ignition element are located in the flow direction of the flow produced by the ventilator. Thereby, already shortly after injection of fuel, it can be successfully ignited, without the pilot flame being blown out. As tests have shown, on the fuel droplets, which are located at the phase boundary of a two-phase mixture of air and fuel, there are formed local ignitable mixing ratios. This concentration of not completely evaporated fuel droplets in the region of the ignition element is advantageously used to reliably ignite fuel mixture already after a very short delay period and despite not yet optimal mixture of air and fuel.

Advantageously, the fuel inlet and the ignition element lie on radii with respect to the combustion chamber axis extending at an angle to each other that lies in a range from 5° to 180°, preferably, from 30° to 120°. Thereby, even at a certain axial distance of the fuel inlet from the ignition element, at least a partial use of the ignition element with the fuel droplets is achieved, which provides for an ignitable air-fuel mixture in the immediate environment of the ignition element and, thereby, for a good ignition of the air-fuel mixture even when the evaporation of the fuel and its mixture with the air in the combustion chamber is not yet optimal.

It is advantageous, when the ignition element is located behind the fuel inlet in a rotational direction of the ventilator. This further improves the ignitability of the air-fuel mixture.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
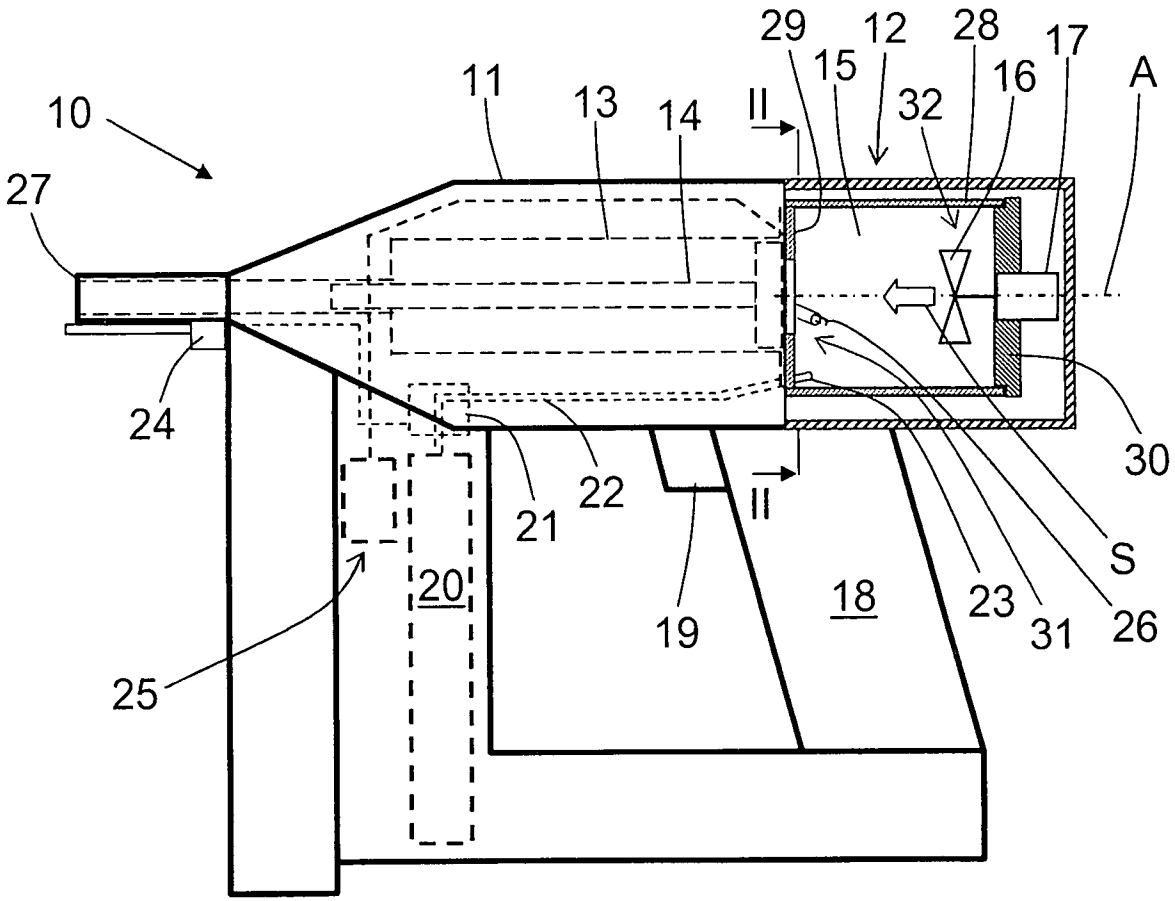
FIG. 1 a partially cross-sectional side view of a combustion-operated setting tool according to the present invention.
Figure 2:
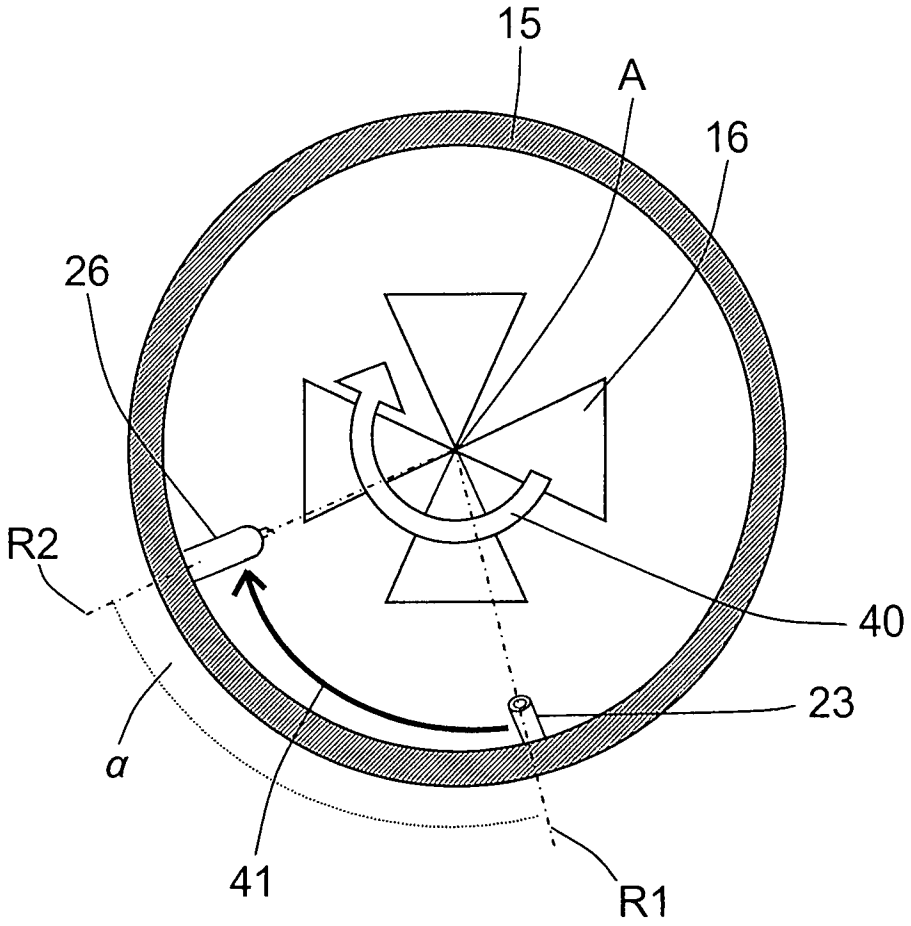
FIG. 2 a cross-sectional view of the inventive setting tool along line II-II in FIG. 1.

A combustion-operated setting tool 10 according to the present invention, which is shown in FIGS. 1-2, includes a one-or multi-part housing generally designated with a reference numeral 11, and a drive 12 located in the housing 11 and driven by an air-fuel mixture. With the drive 12, a fastening element, such as nail, bolt, etc. can be driven in a workpiece. The fastening elements can, e.g., be stored in a magazine secured on the setting tool 10.

The drive 12 includes, among others, a combustion chamber 15 and a guide cylinder 13 which adjoins the combustion chamber 15 and in which a setting piston 14 is axially displaceable. The combustion chamber 15, which defines a combustion chamber axis A, is limited, in its initial position shown in FIG. 1, circumferentially by a combustion chamber sleeve 28 and axially, at its first end, by the setting piston 14 and an annular combustion chamber wall 29 and, at its second end, by a combustion chamber rear wall 30 formed as a cylinder head.

A ventilator 16, which is provided in the region of the second axial end 32 and is driven by a motor 17, serves both for producing a turbulent flow regime of the air-fuel mixture located in the closed combustion chamber 15 and for flushing the open combustion chamber 15 with fresh air after completion of a setting process. The motor 17 is supported on the combustion chamber rear wall 30 that serves for closing of the axially displaceable combustion chamber sleeve 28.

As shown in FIG. 1, a trigger switch 19 is arranged on a handle 18 of the setting tool 10. The trigger switch 19 actuates an ignition device 25 having an ignition element 26 such as, e.g., a spark plug, located in the combustion chamber 15, when the setting tool 10 is pressed against a workpiece. The ignition element 26 is located at the first end 31 of the combustion chamber 15 and, thus, is located in the flow direction S of a flow generated by the ventilator 16.

The setting tool 10 is further provided with a press-on switch 24 that produces an actuation signal when the setting tool 10 is pressed with its muzzle 27 against a workpiece (not shown in the drawings).

The setting tool 10 can be operated with fuel gas or vaporizable liquid fuel available in a fuel reservoir 20 such as, e.g., fuel can. A fuel conduit 22 connects the fuel reservoir 20 with a fuel inlet 23 of the combustion chamber 15. The fuel inlet 23 is provided at the first end 31 of the combustion chamber 15 and is, thus, located in the flow direction S of the flow generated by the ventilator 16.

In the fuel conduit 22, a metering device 21 such as, e.g., metering valve, is located. The metering device 21 is actuated when the press-on switch 24 generates a press-on signal.

As shown in FIG. 2, the ventilator 16 has a predetermined rotational direction 40. The fuel inlet 23 and the ignition element 26 lie on radii R1, R2 with respect to the combustion chamber axis A and which extend at an angle $\alpha$ to each other. The angle $\alpha$ lies in a range from 5° to 180°, preferably, from 30° to 120°. The angle $\alpha$ is adapted to the rotational speed of the ventilator and to the injection direction of the fuel inlet 23. In the embodiment shown in the drawings, the angle $\alpha$ amount to about 80°. As shown with arrow 41, the ignition element 26 is arranged, in the rotational direction 40, behind the fuel inlet 23.

For supplying the electrical consumers such as, e.g., the ignition device and the motor 17 with an electrical energy, there is provided an electrical power source, not shown in the drawings, such as, e.g., an accumulator.

Though the present invention was shown and described with references to the preferred embodiment, such is merely illustrative of the present invention and is not to be construed as a limitation thereof and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A combustion-operated setting tool (10) for driving in fastening elements, comprising:

a guide cylinder (13);

a setting piston (14) displaceable in the guide cylinder (13);

a combustion chamber (15) bordering the guide cylinder, defining a combustion chamber axis (A) and having a first axial end (31) adjacent to the guide cylinder (13) and a second axial end (32) spaced from the guide cylinder (13);

a fuel inlet (23) opening into the combustion chamber (15) substantially parallel to the axis of the combustion chamber for feeding fuel therein and located at the first end surface (31) of the combustion chamber (15);

an ignition element (26) for igniting the fuel in the combustion chamber (15) and likewise located at the first end surface (31) of the combustion chamber (15);

a ventilator (16) located in the combustion chamber (15) and supported on a rear wall (30) of the combustion chamber (15) at the second end (32) thereof; and a motor (17) for driving the ventilator (16).

2. A combustion-operated setting tool (10) according to claim 1, wherein the fuel inlet (23) and the ignition element (26) lie on radii (R1, R2) with respect to the combustion chamber axis (A) extending at an angle ($\alpha$) to each other and that lies in a range from 5° to 180°.

3. A combustion-operated setting tool (10) according to claim 1, wherein the ignition element (26) is located behind the fuel inlet (23) in a rotational direction (40) of the ventilator (16).

4. A combustion-operated setting tool (10) according to claim 1, further comprising a fuel conduit (22) for connecting the fuel inlet (23) with a fuel reservoir.

5. A combustion-operated setting tool (10) according to claim 1, wherein the fuel inlet (23) is located in a flow direction(s) of a flow generated by the ventilator (16).

6. A combustion-operated setting tool (10) according to claim 1, wherein the ignition element (26) located in a flow direction(s) of a flow generated by the ventilator (16).

7. A combustion-operated setting tool (10) according to claim 1 wherein the ignition element (26) is located in a flow direction(s) of a flow generated by the ventilator (16).

8. A combustion-operated setting tool (10) for driving in fastening elements, comprising:

a guide cylinder (13);

a setting piston (14) displaceable in the guide cylinder (13);

a combustion chamber (15) defining a combustion chamber axis (A) and having a front wall (29) adjacent to the setting piston (14) and a rear wall (30) spaced from the setting piston (14);

a fuel inlet (23) opening into the combustion chamber (15) for feeding fuel therein and located in the front surface of the combustion chamber (15);

an ignition element (26) for igniting the fuel in the combustion chamber (15) and secured in the front surface of the combustion chamber (15);

a ventilator (16) supported on the rear wall (30) of the combustion chamber (15); and a motor (17) for driving the ventilator (16).

9. A combustion-operated setting tool (10) according to claim 8, wherein the fuel inlet (23) and the ignition element (26) lie on radii (R1, R2) with respect to the combustion chamber axis (A) extending at an angle (a) to each other and that lies in a range from 5° to 180°.

10. A combustion-operated setting tool (10) according to claim 8, wherein the ignition element (26) is located behind the fuel inlet (23) in a rotational direction (40) of the ventilator (16).

11. A combustion-operated setting tool (10) according to claim 8, further comprising a fuel conduit (22) for connecting the fuel inlet (23) with a fuel reservoir.

12. A combustion-operated setting tool (10) according to claim 8, wherein the ventilator (16) is located in the combustion chamber (15).

13. A combustion-operated setting tool (10) according to claim 8, wherein the fuel inlet (23) is located in a flow direction(s) of a flow generated by the ventilator (16).

14. A combustion-operated setting tool according to claim 8, wherein the fuel inlet (23) opens into the combustion chamber (15) substantially axially.

* * * * *